US007766075B2

(12) United States Patent
Vetrovec et al.

(10) Patent No.: US 7,766,075 B2
(45) Date of Patent: Aug. 3, 2010

(54) MICROCHANNEL HEAT EXCHANGER

(75) Inventors: Jan Vetrovec, Larkspur, CO (US); Tri H. Tran, Arcadia, CA (US)

(73) Assignee: The Boeing Company, Irvine, CA (US)

( * ) Notice: Subject to any disclaimer, the term of this patent is extended or adjusted under 35 U.S.C. 154(b) by 503 days.

(21) Appl. No.: 11/164,903

(22) Filed: Dec. 9, 2005

(65) Prior Publication Data

US 2007/0131403 A1 Jun. 14, 2007

(51) Int. Cl.
*F28F 7/00* (2006.01)
*F28F 3/14* (2006.01)

(52) U.S. Cl. ..... 165/80.4; 165/170

(58) Field of Classification Search ..... 165/170, 165/80.4
See application file for complete search history.

(56) References Cited

U.S. PATENT DOCUMENTS 1,307,812 A * 6/1919 Errickson ..... 264/107
3,361,195 A * 1/1968 Motto, Jr. et al. ..... 165/80.4
3,781,094 A * 12/1973 Griest ..... 359/845
4,516,632 A 5/1985 Swift et al.
4,628,991 A * 12/1986 Hsiao et al. ..... 165/80.4
4,821,389 A 4/1989 Nelson
4,953,634 A 9/1990 Nelson et al.
5,002,123 A 3/1991 Nelson et al.
5,070,936 A * 12/1991 Carroll et al. ..... 165/80.4
5,099,910 A * 3/1992 Walpole et al. ..... 165/80.4
5,186,238 A * 2/1993 del Puerto et al. ..... 165/80.4
5,199,487 A 4/1993 DiFrancesco et al.
5,209,291 A * 5/1993 Taylor ..... 165/168
5,216,580 A * 6/1993 Davidson et al. ..... 361/700
5,263,536 A 11/1993 Hulburd et al.
5,265,670 A * 11/1993 Zingher ..... 165/80.4
5,269,372 A * 12/1993 Chu et al. ..... 165/80.4
5,429,184 A 7/1995 Bach et al.
5,645,127 A * 7/1997 Enderle et al. ..... 165/176
5,706,889 A 1/1998 Bach et al.
5,718,869 A 2/1998 Bach et al.
5,727,618 A 3/1998 Mundinger et al.
5,954,127 A * 9/1999 Chrysler et al. ..... 165/170
5,967,228 A 10/1999 Bergman et al.
6,200,536 B1 3/2001 Tonkovich et al.
6,301,109 B1 * 10/2001 Chu et al. ..... 361/690
6,415,860 B1 7/2002 Kelly et al.
6,446,442 B1 9/2002 Batchelor et al.
6,467,535 B1 10/2002 Shembekar et al.
6,619,044 B2 9/2003 Batchelor et al.

(Continued)

*Primary Examiner*—Cheryl J Tyler
*Assistant Examiner*—Brandon M Rosati
(74) *Attorney, Agent, or Firm*—Moore & Van Allen PLLC; Michael G. Johnston

(57) ABSTRACT

A heat exchanger is provided for transferring heat to a working fluid. The heat exchanger comprises a housing having a plurality of grooves formed in a surface of the housing. The grooves have a first end and a second end, and define fluid flow channels. Each channel has a fluid flow inlet and a fluid flow outlet. The fluid flow inlets of an alternating first set of channels are adjacent to the first end of the grooves, and the fluid flow inlets of a second set of alternating channels are adjacent to the second end of the grooves. The first set of channels and the second set of channels are arranged such that fluid in immediately adjacent channels flows in opposite directions.

27 Claims, 4 Drawing Sheets

U.S. PATENT DOCUMENTS 6,622,519 B1 9/2003 Mathias et al.
6,793,010 B1 9/2004 Manole
6,827,128 B2 * 12/2004 Philpott et al. ..... 165/46
6,892,802 B2 5/2005 Kelly et al.
6,892,803 B2 5/2005 Memory et al.
6,904,966 B2 6/2005 Philpott et al.
6,935,411 B2 8/2005 Valenzuela
2003/0066634 A1 * 4/2003 Valenzuela et al. ..... 165/148
2004/0250994 A1 * 12/2004 Chordia ..... 165/80.4

* cited by examiner

1-DIRECTIONAL FLOW HEX OF PRIOR ART

2-DIRECTION FLOW HEX OF THE SUBJECT INVENTION

MICROCHANNEL HEAT EXCHANGER

BACKGROUND

This invention relates generally to heat exchangers, and more particularly to counter flow microchannel heat exchangers.

There are many industrial devices and processes wherein a component has to be maintained at a precise and uniform temperature. Examples of such devices and processes include optical devices and components, such as precision telescopes, solid-state lasers, and semiconductor laser diodes; wafer processing equipment in the semiconductor industry; and bioprocessing containers in the pharmaceutical industry.

A suitable heat exchanger for these applications can be either of the microchannel type or the impingement type. Microchannel heat exchangers typically use unidirectional liquid coolant flow in a single layer of channels. While a microchannel heat exchanger is conducive to maintaining a very uniform temperature in a component in a direction perpendicular to the coolant flow, the lateral temperature parallel to the direction of coolant flow exhibits an increase as the liquid coolant receives heat. The temperature rise can be limited by increasing the coolant flow rate, but this results in a high pressure drop and poor coolant utilization. A 2-layer, 2-pass microchannel heat exchanger is described in U.S. Pat. No. 5,005,640, the contents of which are hereby incorporated by reference in their entirety. The 2-pass heat exchanger improves lateral temperature uniformity and coolant utilization. However, to achieve the second pass, the direction of coolant flow is reversed, which leads to a very high pressure drop.

Impingement type heat exchangers can provide uniform cooling, but exhibit very high pressure drop and poor coolant utilization.

For the foregoing reasons, there is a need for a microchannel heat exchanger which can provide substantially uniform cooling over a large area. The new microchannel heat exchanger should also handle high heat flux with a low pressure drop.

SUMMARY

According to the present invention, a heat exchanger is provided for transferring heat to a working fluid. The heat exchanger comprises a housing having a plurality of grooves formed in a surface of the housing. The grooves have a first end and a second end, and define fluid flow channels. Each channel has a fluid flow inlet and a fluid flow outlet. The fluid flow inlets of an alternating first set of channels are adjacent to the first end of the grooves, and the fluid flow inlets of a second set of alternating channels are adjacent to the second end of the grooves. The first set of channels and the second set of channels are arranged such that fluid in immediately adjacent channels flows in opposite directions.

Also according to the present invention, a system is provided for controlling the temperature of a heat source. The system comprises a heat generating component having a surface and a heat exchanger having a surface adapted for thermal communication with the surface of the heat generating component. The heat exchanger includes a housing having a plurality of grooves formed in a surface of the housing. The grooves have a first end and a second end, and define fluid flow channels. Each channel has a fluid flow inlet and a fluid flow outlet. The fluid flow inlets of an alternating first set of channels are adjacent to the first end of the grooves, and the fluid flow inlets of a second set of alternating channels are adjacent to the second end of the grooves. The first set of channels and the second set of channels are arranged such that a working fluid in immediately adjacent channels flows in opposite directions.

Further according to the present invention, a method is provided for controlling temperature of a heat source having a surface. The method comprises the steps of providing a heat exchanger having a surface adapted for thermal communication with a surface of the heat source. The heat exchanger includes a housing having a plurality of grooves formed in a surface of the housing. The grooves have a first end and a second end, and define fluid flow channels. Each channel has a fluid flow inlet and a fluid flow outlet. The fluid flow inlets of an alternating first set of channels are adjacent to the first end of the grooves, and the fluid flow inlets of a second set of alternating channels are adjacent to the second end of the grooves. The method further comprises the steps of providing a working fluid, and supplying the working fluid to the channels such that the working fluid in immediately adjacent channels flows in opposite directions for transferring heat from the heat source to the working fluid.

BRIEF DESCRIPTION OF THE DRAWINGS

For a more complete understanding of the present invention, reference should now be had to the embodiments shown in the accompanying drawings and described below. In the drawings.

DESCRIPTION

As used herein, the term "microchannel" refers to a channel having a maximum depth of up to about 10 mm, a maximum width of up to about 2 mm, and any length.

Certain terminology is used herein for convenience only and is not to be taken as a limitation on the invention. For example, words such as "upper," "lower," "left," "right," "horizontal," "vertical," "upward," and "downward" merely describe the configuration shown in the FIGs. Indeed, the components may be oriented in any direction and the terminology, therefore, should be understood as encompassing such variations unless specified otherwise.

Figure 1:
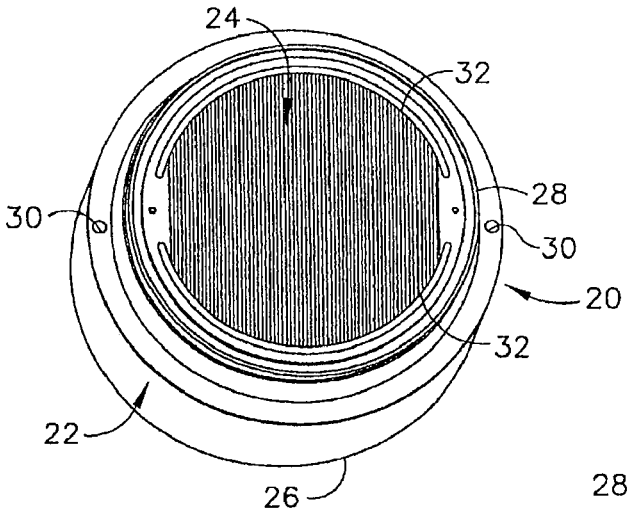
FIG. 1 is a perspective view of an embodiment of a microchannel heat exchanger according to the present invention.

Referring now to the drawings, wherein like reference numerals designate corresponding or similar elements throughout the several views, a counter flow microchannel heat exchanger according to the present invention is shown in FIG. 1 and generally designated at 20. The heat exchanger 20 comprises a housing 22 having a single layer of a plurality of parallel microchannels 24. As will be described below, the heat exchanger 20 is designed such that a fluid coolant flows through adjacent alternating microchannels in opposite directions. This counter-flow configuration reduces the lateral temperature variation as compared to a unidirectional flow heat exchanger, while maintaining low pressure drop and high coolant utilization.

The housing 22 of the heat exchanger 20 comprises two separate portions, a base portion 26 and a surface portion 28. The surface portion 28 of the housing 22 has a plurality of slots which define the microchannels 24. The housing 22 shown in the FIGs. is generally cylindrical. A cylindrically-shaped housing 22 represents a compact design and minimizes coolant flow thereby reducing power requirements for a liquid coolant pump. However, it is understood that the housing 22 of the heat exchanger 20 can be any shape, including rectilinear. Opposed holes 30 are formed in the housing 22 of the heat exchanger 20 for receiving pins on the component to be cooled (not shown) in order to provide proper angular alignment of the housing 22 relative to the component.

The base portion 26 and the surface portion 28 of the heat exchanger 20 are preferably formed from single crystal silicon and bonded together to form an integral unit. The heat exchanger 20 may also be constructed of a material comprising a metal (e.g, aluminum, nickel, copper, stainless steel or other steel alloys), ceramics, glass, graphite, single crystal diamond, polycrystalline diamond, a polymer (e.g., a thermoset resin), or a combination thereof. These materials possess thermal conductivities that are sufficient to provide the necessary requirements for overall heat transfer coefficients. It is understood that the scope of the invention is not intended to be limited by the materials listed here, but may be carried out using any material which allows the construction and operation of the heat exchanger described herein.

The microchannels 24 are defined by the walls of the slots extending from the surface portion 28 of the housing 22. The number of microchannels 24 may be any desired number, for example, two, three, four, five, six, eight, tens, hundreds, thousands, tens of thousands, hundreds of thousands, millions, etc. The microchannels 24 may have a cross-section having any shape, for example, a square, a rectangle or a circle. Each of the microchannels 24 may have an internal width ranging from about 50 μm up to about 2 mm. As shown in FIG. 1, the microchannel array 24 is circular, and the microchannels extend in parallel substantially across the surface portion 28 of the housing 22. In this configuration, the depth of the microchannels 24 varies in order to match flow impedance and thus achieve the same heat transfer conditions in spite of the different microchannel lengths. Alternatively, the microchannel array 24 may be rectangular, square, polygonal, or any other suitable shape. The microchannels 24 can be straight or curved, and the depth of the microchannels can be constant or variable.

Figure 2:
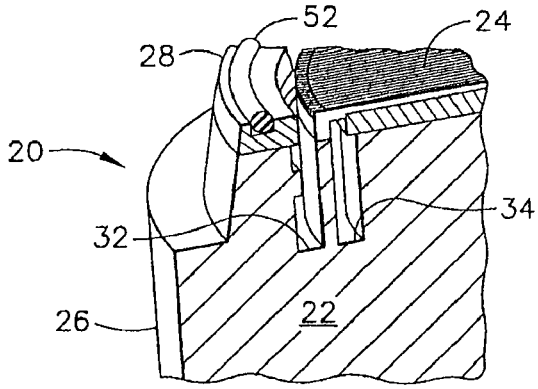
FIG. 2 is a close up cross-section view of an upper peripheral portion of the heat exchanger of FIG. 1 showing a supply manifold and a return manifold.
Figure 3:
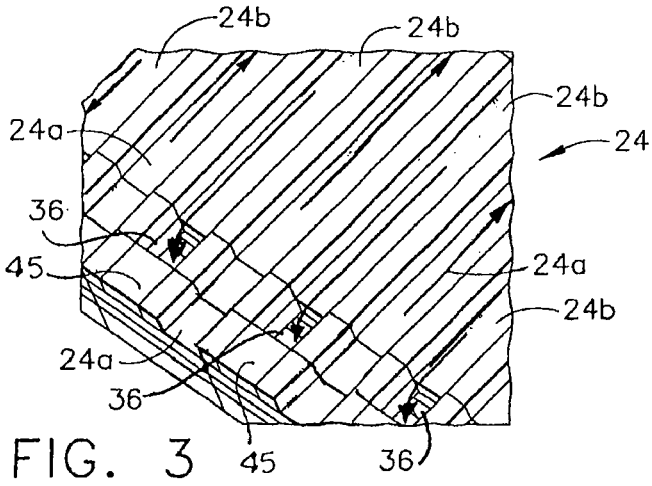
FIG. 3 is a close up perspective view of a portion of the upper surface of the heat exchanger of FIG. 1 showing an open microchannel array.

A suitable supply manifold 32 provides for the flow of the fluid coolant into the microchannels 24. A suitable return manifold 34 provides for the coolant return. In the embodiment of the present invention shown in the FIGs., the supply manifold 32 and the return manifold 34 are each a pair of radially opposed crescent-shaped openings formed in the housing 22. As seen in FIGS. 1 and 2, each of the supply manifold 32 openings penetrates the surface portion 28 of the housing 22 and extends nearly one half of the circumference of the housing 22. The supply manifold 32 openings open onto the ends of the microchannels 24. Each of the opposed supply manifold 32 openings communicates with alternate microchannels 24, whereby one supply manifold 32 opening passes fluid coolant to alternating microchannels 24 extending in one direction, and the other supply manifold 32 passes fluid coolant to the adjacent alternating microchannels 24 extending in the other direction. As shown in FIG. 3, inlets 36 to the corresponding return manifold 34 are formed in the bottom of alternating slots at the opposite end of the microchannels 24 from the supply manifold 32.

The microchannel heat exchanger 20 of the present invention can be used with either open channels or closed channels. In the open channel configuration, shown in FIGS. 1-3, the heat generating component (not shown) is positioned against the upper surface 28 of the housing 22 and is in direct contact with the fluid coolant. In the closed channel configuration, shown schematically in FIGS. 4 and 5, a wall 38 defines the upper surface of the heat exchanger 20. The wall 38 seals in the fluid coolant by closing the top of the microchannels 24 and forms an outside surface of the heat exchanger 20. The use of open microchannels versus closed microchannels depends upon the heat generating component to be cooled. While the wall 38 between the fluid coolant and the heat generating component can be made very small, heat transfer will nevertheless depend upon conduction through the boundary layers between the heat exchanger 20 and the heat generating component. If the contact heat transfer coefficients are low, heat exchange is inefficient. A much higher heat flux is possible with open channels because the component to be cooled is in direct contact with the fluid coolant.

A suitable fluid coolant for use according to the present invention is deionized water. It is understood that the coolant may be any fluid, gas or liquid, for use in a heat exchanger, and is not limited to water or other liquid coolants. Other suitable coolants include alcohol, liquid propane, antifreeze, gaseous or liquid nitrogen, freons, air, and mixtures thereof. Preferably, the coolant has low viscosity.

Figure 4:
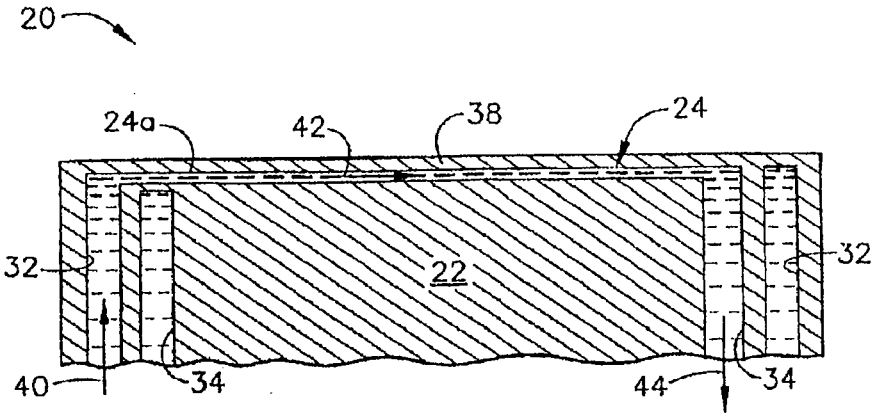
FIG. 4 is a cross-section view taken along line 4-4 of FIG. 1.
Figure 5:
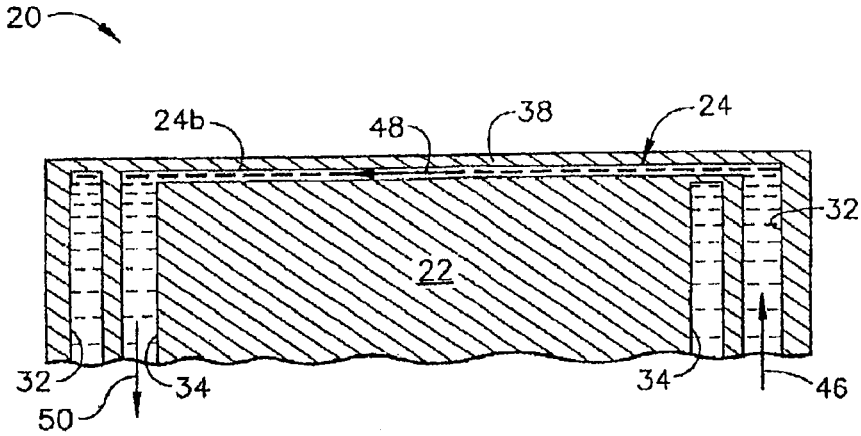
FIG. 5 is a cross-section view taken along line 5-5 of FIG. 1.

Operation of the heat exchanger 20 according to the present invention is shown in the schematic cross-sectional views of the housing 22 shown in FIGS. 4 and 5, which depict microchannels 24*a*, 24*b* having opposite fluid flow directions. The arrows denote the direction of fluid flow. Referring to FIG. 4, fluid coolant is pumped into the supply manifold 32 as indicated by arrow 40. Fluid passes from the supply manifold 32 through the supply manifold opening from which the fluid coolant enters the microchannel 24*a*. Fluid flows across the plane of the heat exchanger 20 via the microchannel 24*a* as indicated by arrow 42. Fluid falls through the inlet opening 36 of the return manifold 34 at the end of the microchannel 24*a* and through the return manifold 34 as indicated by arrow 44. The walls of the slots define a closed end (45) of the microchannels adjacent the inlet openings (36) of the return manifold (34) (FIG. 3).

Referring to FIG. 5, fluid coolant is pumped into the supply manifold 32 as indicated by arrow 46. Fluid passes from the supply manifold 32 through the supply manifold opening from which the fluid coolant enters the microchannel 24*b*. Fluid flows across the plane of the heat exchanger 20 via the microchannel 24*b* as indicated by arrow 48, which is in a direction opposite to the direction indicated by arrow 42. Fluid falls through the inlet opening 36 of the return manifold 34 at the end of the microchannel 24*b* and through the return manifold 34 as indicated by arrow 50. Although it is not shown, the supply manifold 32 and the return manifold 34 transition into a round cross-section and continue in a downward direction as seen in the FIGs. Once the fluid enters the return manifold 34, the $\Delta P$ is low because the cross-section of the flow member is large. The fluid coolant then returns to the pump where the cycle starts again.

The heat exchanger 20 according to the present invention may be used with any heat generating component. The heat exchanger 20 is particularly suitable for use with optical components. In this application, the upper surface portion 28 of the heat exchanger 20 is formed to be optically flat. This feature allows the heat exchanger 20 to seal against an optically flat heat generating component upon contact, which is sufficient to provide a fluid tight seal. As seen in FIG. 2, an o-ring 52 may be provided in a circumferential groove in the surface portion 28 of the housing 22 to provide a fluid tight seal. A seal may also be accomplished for other applications by soldering or other means.

The counter-flow microchannel heat exchanger 20 according to the present invention has many advantages, including reducing the temperature variation provided by a unidirectional flow heat exchanger by a factor of about 5, while maintaining low pressure drop and low fluid coolant utilization. By flowing fluid coolant in opposite directions in adjacent microchannels, the increase in coolant temperature in a direction parallel to the coolant flow is minimized. The heat exchanger can also provide substantially uniform cooling over a large area, typically about 100 $cm^2$ to about 1000 $cm^2$, and can handle high heat flux (10-1000 $W/cm^2$) with a low pressure drop.

Example

Table 1 lists parameters of an exemplary unidirectional microchannel heat exchanger and an exemplary counter-flow open microchannel heat exchanger according to the present invention.

TABLE 1

| | HEX10A Parallel flow | HEX10A Counter flow |
|---|---|---|
| Channel width [μm] | 610 | 610 |
| Land width [μm] | 406 | 406 |
| Channel depth [μm] | 1525 | 1525 |
| Water film coef. [$w/cm^2$-K] | 3.3 | 3.3 |
| Contact film coef. [$w/cm^2$-K] | 1.9 | 1.9 |
| Channel water flow rate [gm/s] | 5.5 | 5.5 |
| Channel water ΔT [° K] | 3.35 | 3.35 |
| Channel ΔP [psid] | 15 psid | 15 psid |
| Model ΔT(max) [K] | 107.0 | 105.6 |
| ΔOPD [μm] due to water temperature rise | 0.22 (~1/5 λ) | 0.022 (~1/48 λ) |

Figure 6:
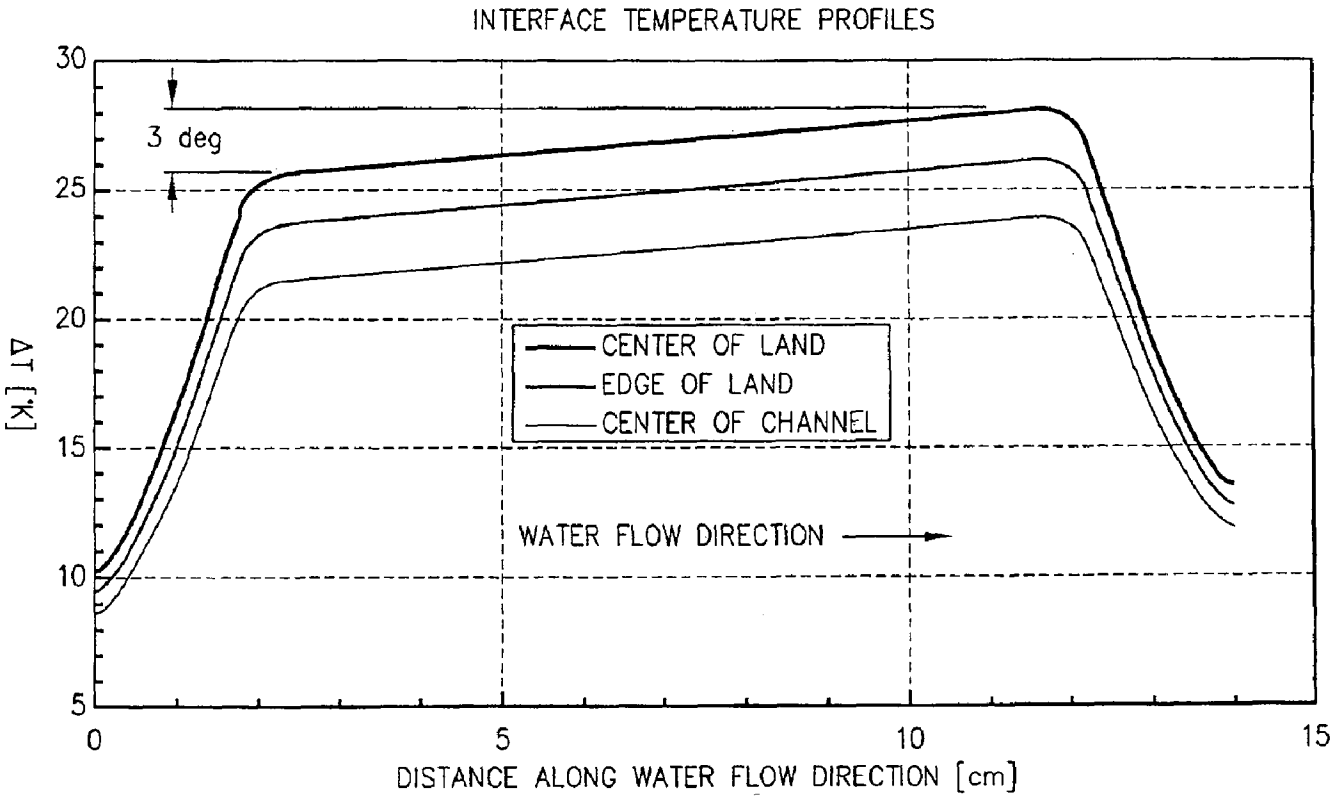
FIG. 6 is a graph showing the temperature rise in a cooled component as a function of position downstream from the supply manifold in a prior art unidirectional flow microchannel heat exchanger.
Figure 7:
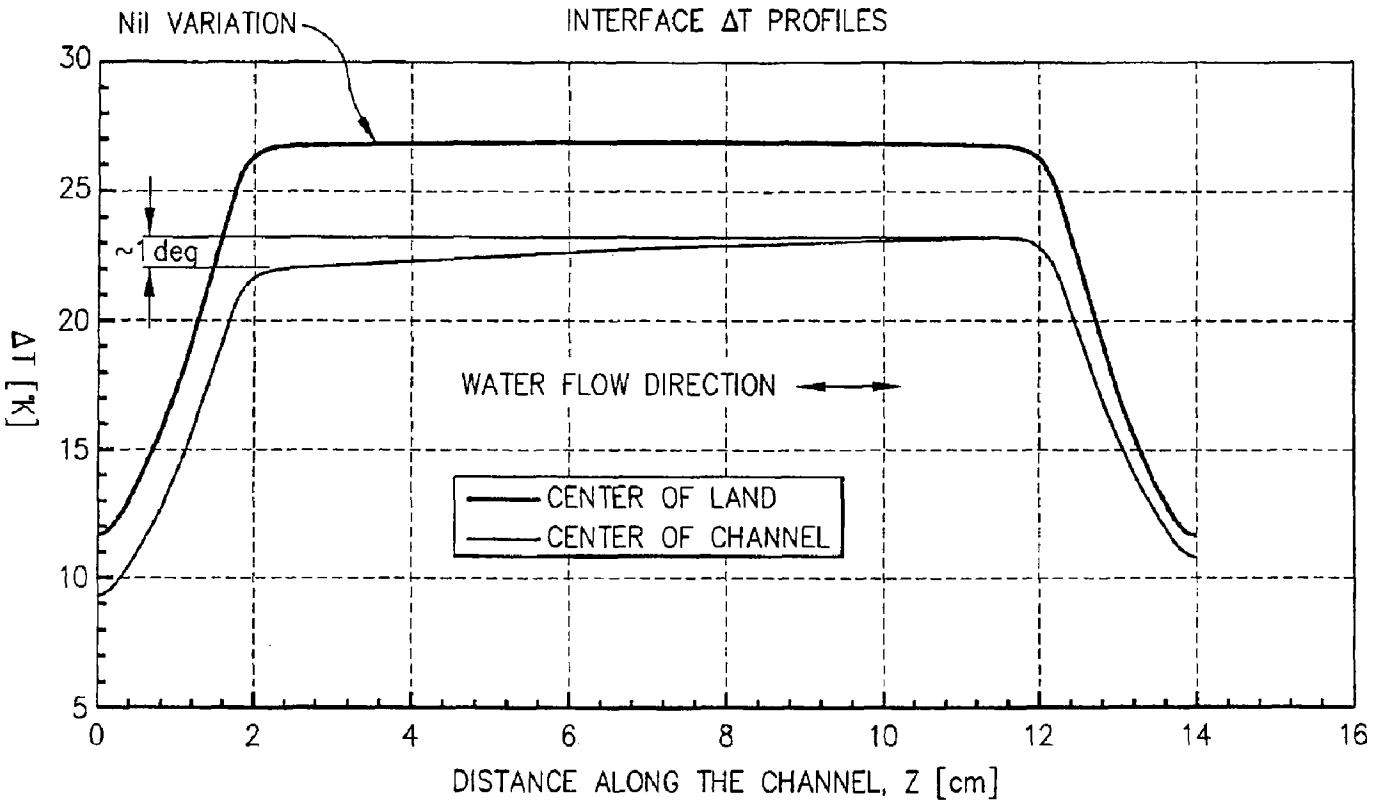
FIG. 7 is a graph showing the temperature rise in a cooled component as a function of position downstream from the supply manifold in a counter-flow microchannel heat exchanger according to the present invention.

The results of a computer simulation of the two heat exchangers used to cool an optical component, a second surface mirror, are shown in FIGS. 6 and 7. The counter-flow open microchannel heat exchanger according to the present invention reduced the optical path difference (OPD) in the optical component from 0.22 um in the unidirectional microchannel heat exchanger to 0.022 um.

Although the present invention has been shown and described in considerable detail with respect to only a few exemplary embodiments thereof, it should be understood by those skilled in the art that I do not intend to limit the invention to the embodiments since various modifications, omissions and additions may be made to the disclosed embodiments without materially departing from the novel teachings and advantages of the invention, particularly in light of the foregoing teachings. Accordingly, I intend to cover all such modifications, omission, additions and equivalents as may be included within the spirit and scope of the invention as defined by the following claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

What is claimed is:

1. A heat exchanger for transferring heat from a heat source to a working fluid, the heat exchanger comprising a housing having a plurality of grooves formed in a surface of the housing, the grooves having a first end and a second end and defining fluid flow channels open at one end, each channel having a fluid flow inlet at the open end and closed at the other end, and a fluid flow outlet at the closed end, the fluid flow inlets at the open ends of an alternating first set of the fluid flow channels adjacent to the first end of the grooves, and the fluid flow inlets at the open ends of a second set of alternating fluid flow channels adjacent to the second end of the grooves, wherein the first set of the fluid flow channels and the second set of the fluid flow channels are arranged such that fluid in immediately adjacent channels flows in opposite directions, the housing defining a distribution manifold having a pair of openings onto the surface of the housing, one of the pair of openings adjacent the first end of the grooves and the other of the pair of openings adjacent the second end of the grooves for supplying fluid to the fluid flow channels, wherein the one and the other of the pair of distribution manifold openings extend continuously the full length of the ends of the plurality of grooves such that the openings are in fluid communication with the open ends of the fluid flow channels, and the housing defining a return manifold for removing fluid, wherein the return manifold is in fluid communication with the fluid flow outlets of the alternating first set of fluid flow channels at the second end and the alternating second set of fluid flow channels at the first end.

2. A heat exchanger as recited in claim 1, wherein the housing is substantially cylindrical.

3. A heat exchanger as recited in claim 1, wherein the housing is formed from silicon, metal, ceramics, glass, graphite, single crystal diamond, polycrystalline diamond, a polymer, or combinations thereof.

4. A heat exchanger as recited in claim 3, wherein the metal from which the housing is formed is selected from aluminum, nickel, copper, stainless steel, steel alloys, or combinations thereof.

5. A heat exchanger as recited in claim 1, wherein the surface of the housing is substantially optically flat.

6. A heat exchanger as recited in claim 1, wherein the grooves are substantially straight.

7. A heat exchanger as recited in claim 6, wherein the grooves are substantially parallel.

8. A heat exchanger as recited in claim 1, wherein the grooves are substantially curved.

9. A heat exchanger as recited in claim 1, wherein the channels are open.

10. A heat exchanger as recited in claim 9, wherein the cross-section of the channels is substantially U-shaped.

11. A heat exchanger as recited in claim 1, wherein the grooves have a bottom wall, a top wall, and at least two side walls extending between and interconnecting the bottom and top walls.

12. A heat exchanger as recited in claim 1, wherein the cross-section of the channels is substantially circular.

13. A system for controlling temperature of a heat source, the system comprising:

a heat generating component having a surface;

a heat exchanger having a surface adapted for thermal communication with the surface of the heat generating component, the heat exchanger including a housing having a plurality of grooves formed in the surface of the housing, the grooves having a first end and a second end and defining fluid flow channels open at one end, each channel having a fluid flow inlet at the open end and closed at the other end, and a fluid flow outlet at the closed end, the fluid flow inlets at the open ends of an alternating first set of the fluid flow channels adjacent to the first end of the grooves, and the fluid flow inlets at the open ends of a second set of alternating fluid flow channels adjacent to the second end of the grooves, the housing defining a distribution manifold having a pair of openings onto the surface of the housing, one of the pair of openings adjacent the first end of the grooves and the other of the pair of openings adjacent the second end of the grooves for supplying fluid to the fluid flow channels, wherein the one and the other of the pair of distribution manifold openings extend continuously the full length of the ends of the plurality of grooves such that the openings are in fluid communication with the open ends of the fluid flow channels, and the housing defining a return manifold for removing fluid, wherein the return manifold is in fluid communication with the fluid flow outlets of the alternating first set of the fluid flow channels at the second end and the alternating second set of the fluid flow channels at the first end; and a working fluid, wherein the first set of the fluid flow channels and the second set of the fluid flow channels are arranged such that the working fluid in immediately adjacent fluid flow channels flows in opposite directions.

14. A system as recited in claim 13, wherein the housing is formed from silicon, metal, ceramics, glass, graphite, single crystal diamond, polycrystalline diamond, a polymer, or combinations thereof.

15. A system as recited in claim 14, wherein the metal from which the housing is formed is selected from aluminum, nickel, copper, stainless steel, steel alloys, or combinations thereof.

16. A system as recited in claim 13, wherein the surface of the heat generating component and the surface of the housing are substantially optically flat.

17. A system as recited in claim 13, wherein the grooves are substantially straight.

18. A system as recited in claim 17, wherein the grooves are substantially parallel.

19. A system as recited in claim 13, wherein the grooves are substantially curved.

20. A system as recited in claim 13, wherein the channels are open so that the working fluid is in direct contact with the heat generating component.

21. A system as recited in claim 13, wherein the grooves have a bottom wall, a top wall, and at least two side walls extending between and interconnecting the bottom and top walls.

22. A method for controlling temperature of a heat source having a surface, the method comprising the steps of:

providing a heat exchanger including a housing having a surface adapted for thermal communication with the surface of the heat source, the housing having a plurality of grooves formed in the surface of the housing, the grooves having a first end and a second end and defining fluid flow channels open at one end, each channel having a fluid flow inlet at the open end and closed at the other end, and a fluid flow outlet at the closed end, the fluid flow inlets at the open ends of an alternating first set of the fluid flow channels adjacent to the first end of the grooves, and the fluid flow inlets at the open ends of a second set of alternating fluid flow channels adjacent to the second end of the grooves, the housing defining a distribution manifold having a pair of openings onto the surface of the housing, one of the pair of openings adjacent the first end of the grooves and the other of the pair of openings adjacent the second end of the grooves for supplying fluid to the fluid flow channels, wherein the one and the other of the pair of distribution manifold openings extend continuously the full length of the ends of the plurality of grooves such that the openings are in fluid communication with the open ends of the fluid flow channels, and the housing defining a return manifold for removing fluid, wherein the return manifold is in fluid communication with the fluid flow outlets of the alternating first set of the fluid flow channels at the second end and the alternating second set of the fluid flow channels at the first end;

providing a working fluid; and supplying the working fluid to the fluid flow channels such that the working fluid in immediately adjacent fluid flow channels flows in opposite directions for transferring heat from the heat source to the working fluid.

23. A method for controlling temperature of a heat source as recited in claim 22, wherein the grooves are substantially straight.

24. A method for controlling temperature of a heat source as recited in claim 23, wherein the grooves are substantially parallel.

25. A method for controlling temperature of a heat source as recited in claim 22, wherein the grooves are substantially curved.

26. A method for controlling temperature of a heat source as recited in claim 22, wherein the channels are open so that the working fluid is in direct contact with the heat source.

27. A method for controlling temperature of a heat source as recited in claim 22, wherein the grooves have a bottom wall, a top wall, and at least two side walls extending between and interconnecting the bottom and top walls.

* * * * *